US009776033B2

(12) United States Patent
Fasullo

(10) Patent No.: US 9,776,033 B2
(45) Date of Patent: Oct. 3, 2017

(54) YOGA MAT ASSEMBLY

(71) Applicant: Snap Mat Systems Inc., Fort Langley (CA)

(72) Inventor: Luciano Fasullo, Fort Langley (CA)

(73) Assignee: Snap Mat Systems Inc., Fort Langley (CA)

( * ) Notice: Subject to any disclaimer, the term of this patent is extended or adjusted under 35 U.S.C. 154(b) by 0 days.

(21) Appl. No.: 14/469,212

(22) Filed: Aug. 26, 2014

(65) Prior Publication Data

US 2016/0059065 A1 Mar. 3, 2016

(51) Int. Cl.
*A47G 9/06* (2006.01)
*A63B 21/00* (2006.01)

(52) U.S. Cl.
CPC ..... *A63B 21/1473* (2013.01); *A63B 21/4037* (2015.10)

(58) Field of Classification Search
CPC ..... A63B 21/4037; A47G 9/06; A47G 9/062; A47D 15/003
See application file for complete search history.

(56) References Cited

U.S. PATENT DOCUMENTS 5,887,299 A 3/1999 Phillips
6,276,828 B1 8/2001 Otley et al.
6,961,969 B2 11/2005 Nichols
7,485,071 B2 2/2009 Edwards
8,220,087 B2 * 7/2012 Villa ..... A63B 21/4037 482/142
8,631,833 B2 1/2014 Garbarino
9,015,881 B2 4/2015 Kress
2004/0250346 A1 12/2004 Vasishth
2005/0192158 A1 9/2005 Edwards
2007/0275827 A1 * 11/2007 Glaser ..... A63B 21/4037 482/23
2008/0152860 A1 * 6/2008 Meyer ..... A63B 6/00 428/100
2011/0114235 A1 * 5/2011 Hartley ..... A63B 71/00 150/154
2012/0124739 A1 * 5/2012 Crowne ..... A63B 21/4037 5/417
2012/0177867 A1 * 7/2012 Kuo ..... A47L 23/266 428/71

(Continued)

FOREIGN PATENT DOCUMENTS

CN 202169040 3/2012
CN 202844447 4/2013
WO 2013163669 11/2013

OTHER PUBLICATIONS

English Translation of CN202169040.

(Continued)

*Primary Examiner* — David E Sosnowski
(74) *Attorney, Agent, or Firm* — Cameron IP

(57) ABSTRACT

There is accordingly provided a yoga mat assembly. The assembly has a length. The assembly comprises a yoga mat. The assembly comprises a moisture-absorbent covering member shaped to extend over top of the yoga mat. The assembly comprises a plurality of fasteners spaced-apart apart along the length of the assembly at peripheral portions thereof. The fasteners selectively fasten the yoga mat and the covering member together.

17 Claims, 7 Drawing Sheets

(56) References Cited

U.S. PATENT DOCUMENTS

| | | | | |
|---|---|---|---|---|
| 2012/0227181 | A1* | 9/2012 | Cintas | A45C 3/00 5/420 |
| 2012/0260421 | A1* | 10/2012 | DeGregorio | A47G 27/0206 5/417 |
| 2012/0304382 | A1* | 12/2012 | Sole | A47G 27/0206 5/487 |
| 2013/0125307 | A1* | 5/2013 | Margalit | A47K 10/02 5/417 |
| 2013/0276230 | A1 | 10/2013 | Kress | |
| 2014/0068858 | A1* | 3/2014 | Wambeke | A47G 9/062 5/420 |
| 2014/0178664 | A1* | 6/2014 | D'Orazio | B32B 25/16 428/220 |
| 2014/0259399 | A1* | 9/2014 | Tsai | A63B 21/00105 5/420 |

OTHER PUBLICATIONS

International Search Report and Written Opinion for PCT/CA2015/050702, dated Oct. 29, 2015.
English Abstract of CN 202844447.

* cited by examiner

YOGA MAT ASSEMBLY

FIELD OF THE INVENTION

There is provided a mat assembly. In particular, there is provided a yoga mat assembly.

DESCRIPTION OF THE RELATED ART

United States Patent Publication No. 2005/0192158 to Edwards discloses composite yoga mats. Each mat comprises a fabric sheet with a frictional material. The mat may include loop holes to provide support. The mat may also include a stable surface and moisture absorption for the practice of yoga. Edwards recites that composite yoga mats can have connectors at the peripheral edges to attach them to other mats to provide moisture absorbency and these connectors may include snaps and the like. The preferred embodiment in Edwards shown in the drawings describes a smaller yoga mat with loop holes at the front and rear ends of the mat. The smaller mat may be bounded to a larger mat with hook and loop strips.

Such a system may result in bunching and wrinkling between the contact points and the surface material during a rigorous yoga workout. A yoga mat assembly so wrinkled and bunched together may become a safety hazard when performing other active movements on the assembly.

There is accordingly a need for an improved yoga mat assembly that overcomes the above disadvantages.

BRIEF SUMMARY OF INVENTION

There is provided an improved yoga mat assembly disclosed herein that may overcome the above disadvantages.

There is accordingly provided a yoga mat assembly. The assembly has a length. The assembly comprises a yoga mat. The assembly comprises a moisture-absorbent covering member shaped to extend over top of and substantially cover the yoga mat. The assembly comprises a plurality of fasteners spaced-apart apart along the length of the assembly at peripheral portions thereof. The fasteners selectively fasten the yoga mat and the covering member together.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
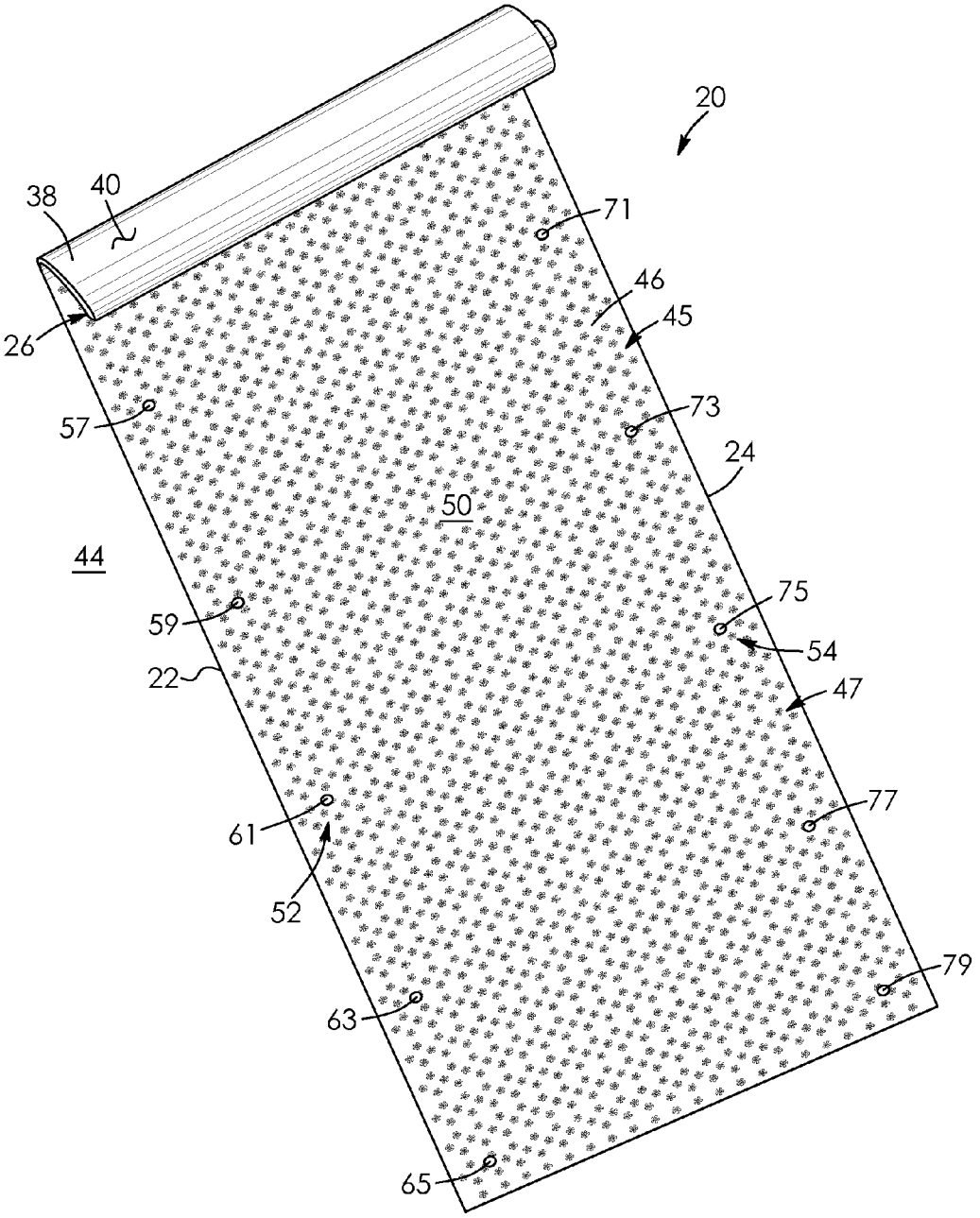
FIG. 1 is a top perspective view of a yoga mat assembly according to a first aspect, the assembly comprising a yoga mat, a moisture-absorbent fabric sheet and a plurality of fasteners selectively fastening the fabric sheet to the yoga mat, the assembly being partially rolled-up.
Figure 6:
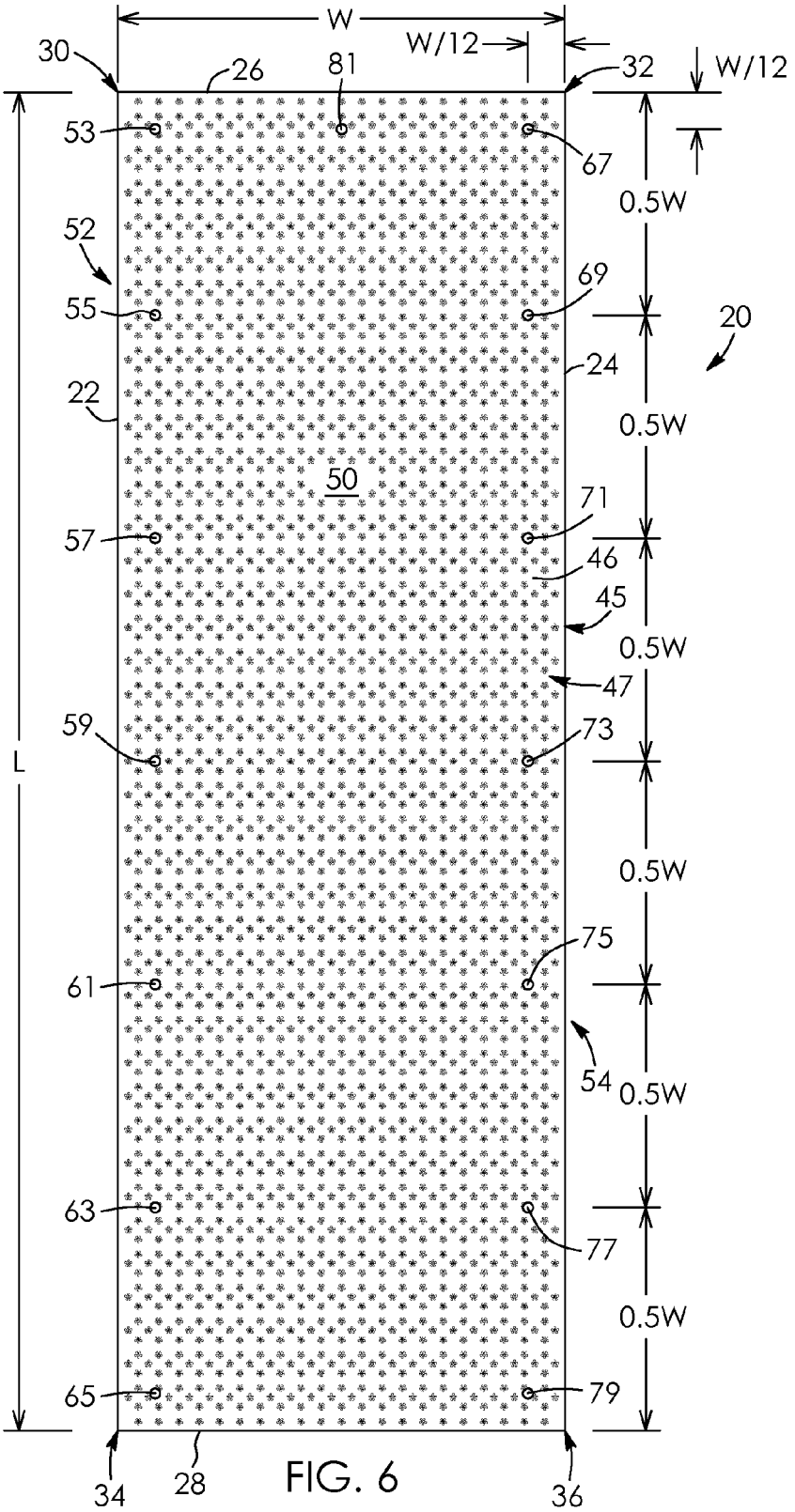
FIG. 6 is a top plan view of the assembly of FIG. 1.

Referring to the drawings and first to FIG. 1, there is shown a yoga mat assembly 20 according to a first aspect. As seen in FIG. 6, the assembly has a length L and a width W extending tangential to the length. The assembly 20 has a first longitudinal side edge 22 and a second longitudinal side edge 24 spaced-apart from the first longitudinal side edge. The longitudinal side edges extend along the length L of the assembly.

As seen in FIG. 6, the assembly 20 has a forward end 26 and a rearward end 28 spaced-apart from the forward end. The ends 26 and 28 extend between the longitudinal side edges 22 and 24 of the assembly and may be referred to as lateral ends. The assembly has corner portions 30, 32, 34 and 36. Each corner portion is adjacent to a respective side edge and a respective end, as seen by corner portion 32 in FIG. 6 which is adjacent to side edge 24 and end 26.

Figure 3:
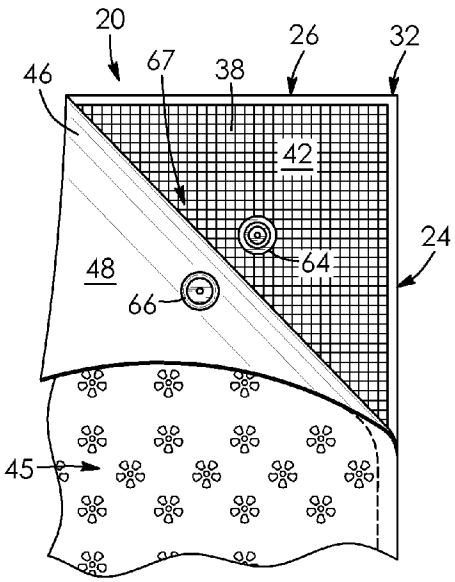
FIG. 3 is a top perspective view of the yoga mat assembly in fragment showing the yoga mat and female portion of the fastener of FIG. 2 and a corresponding male portion of said one of the fasteners connected to the fabric sheet, the fabric sheet being partially folded to reveal the male portion.
Figure 2:
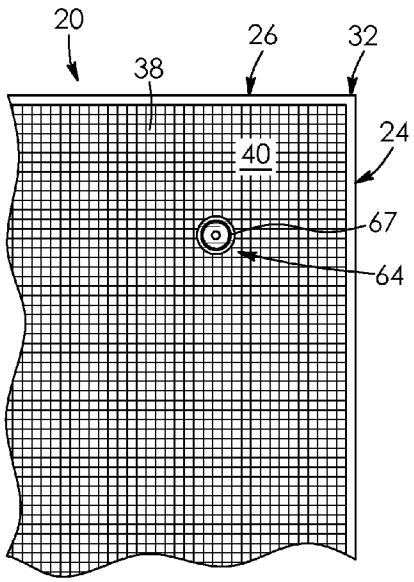
FIG. 2 is a bottom perspective view of the yoga mat assembly of FIG. 1 in fragment showing the bottom of the yoga mat and a female portion of one of the fasteners connected thereto.

The assembly 20 comprises a yoga mat 38, as seen in FIGS. 1 to 3. The yoga mat has a bottom 40, seen in FIGS. 1 and 2, and a top 42 seen in FIG. 3. The yoga mat 38 is resilient and provides cushioning to the user. The mat is also configured to frictionally engage with the floor 44, seen in FIG. 1. The yoga mat as described thus far is conventional, with parts and functions well-known to those skilled in the art.

The assembly 20 comprises a covering member 45. In this example, the covering member comprises a moisture-absorbent fabric sheet 46. The covering member has a bottom 48, seen in FIG. 3, and a top 50 seen in FIG. 4. The fabric sheet 46 is shaped and sized to extend over top of the yoga mat 38. The fabric sheet is configured to inhibit slipping when wet and has a coefficient of friction that is greater than that of the yoga mat. The fabric sheet 46 is terry cloth according to one aspect. According to another aspect, the fabric sheet is microfiber cloth in one example. This may be referred to as "stainless steel" cloth, though it is not actually made of stainless steel.

Figure 4:
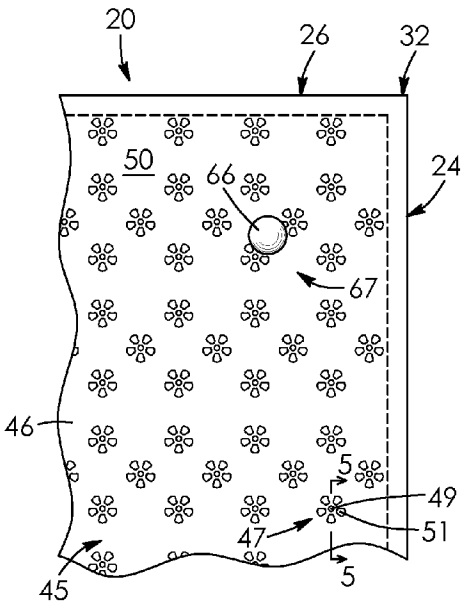
FIG. 4 is a top perspective view of the yoga mat assembly of FIG. 3 connecting the fabric sheet to the yoga mat.
Figure 5:
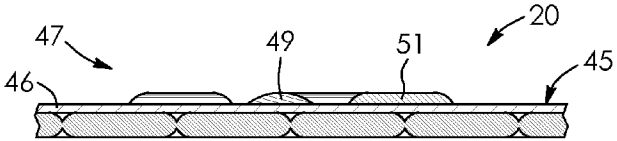
FIG. 5 is a sectional view taken along lines 5-5 of FIG. 4, showing a cluster of outwardly extending gripping protrusions extending from the fabric sheet of the assembly.

As best seen in FIGS. 4 and 5, the covering member 45 further comprises a plurality of clusters of gripping protrusions in this example, as seen by cluster 47 comprising a central protrusion 49 together with five outer protrusions 51 positioned around the central protrusion in a pentagonal arrangement in this example. The central protrusions are circular in profile when viewed from above and convex in this example. The outer protrusions 51 are annular in segment when viewed from above in this example. The outer protrusions are arranged in an annular manner about the central protrusion 49 and are circumferentially spaced-apart from each other in this example. The clusters 47 are longitudinally and laterally spaced-apart from each other. Each of the protrusions 49 and 51 connects to, is positioned along and extends outwards from the top 50 of the covering member 45. The protrusions are water-proof and are made of plastic in this example, though this is not strictly required. The protrusions 49 and 51 increase the coefficient of friction of the top 50 of the covering member and are configured to inhibit slipping when the fabric sheet is wet, for example.

Referring now to FIG. 6, the assembly 20 includes a plurality of fasteners spaced-apart apart along the length L of the assembly at the peripheral portions thereof, including a first row 52 of fasteners 53, 55, 57, 59, 61, 63 and 65 extending along and adjacent to the first side edge 22 of the assembly and a second row 54 of fasteners 67, 69, 71, 73, 75, 77 and 79 extending along and adjacent to the second side edge 24 of the assembly. The distance between adjacent fasteners is generally equal to or less than one half of the width W of the assembly, as shown by the distance D between fasteners 75 and 77 of row 54. An additional fastener 81 is interposed between the longitudinal side edges 22 and 24 of the assembly 20 adjacent to the forward end 26 thereof.

As seen in FIG. 6, outer ones of the fasteners are arranged at the corner portions of the assembly 20, as shown by fastener 67 adjacent to corner portion 32. The outer fasteners 53, 65, 67 and 79 are spaced-apart from adjacent longitudinal side edges and lateral ends of the assembly by a distance equal to or less than one twelfth of the width of the assembly.

The fasteners are snap fasteners in this example. Each snap fastener comprises a male member connected to a first one of the yoga mat and the fabric sheet and a female member connected to a second one of the yoga mat and the fabric sheet. This is shown in FIG. 2 by female member 64 of fastener 67 coupling to yoga mat 38 and male member 66 coupling to fabric sheet 46 in FIG. 3. The female members are shaped to selectively receive and couple with the male members. Snap fasteners per se are well-known to those skilled in the art and their various parts and functionings will thus not be described in further detail.

As seen in FIG. 3, the fasteners selectively fasten the top 42 of yoga mat 38 and the bottom 48 of covering member 45 together and enable the fabric sheet to be readily removeable for washing. This may be particularly useful for people who perform hot yoga. The fasteners so arranged function to inhibit wrinkling of the fabric sheet. The fasteners are further arranged such that shear forces arising from the use of the assembly are evenly distributed amongst the fasteners, inhibiting longitudinal and lateral movement of the fabric sheet relative to the yoga mat thereby. The assembly 20 as herein described may thus enable people to practice yoga exercise in a manner that is safe, comfortable and hygienic.

Figure 7:
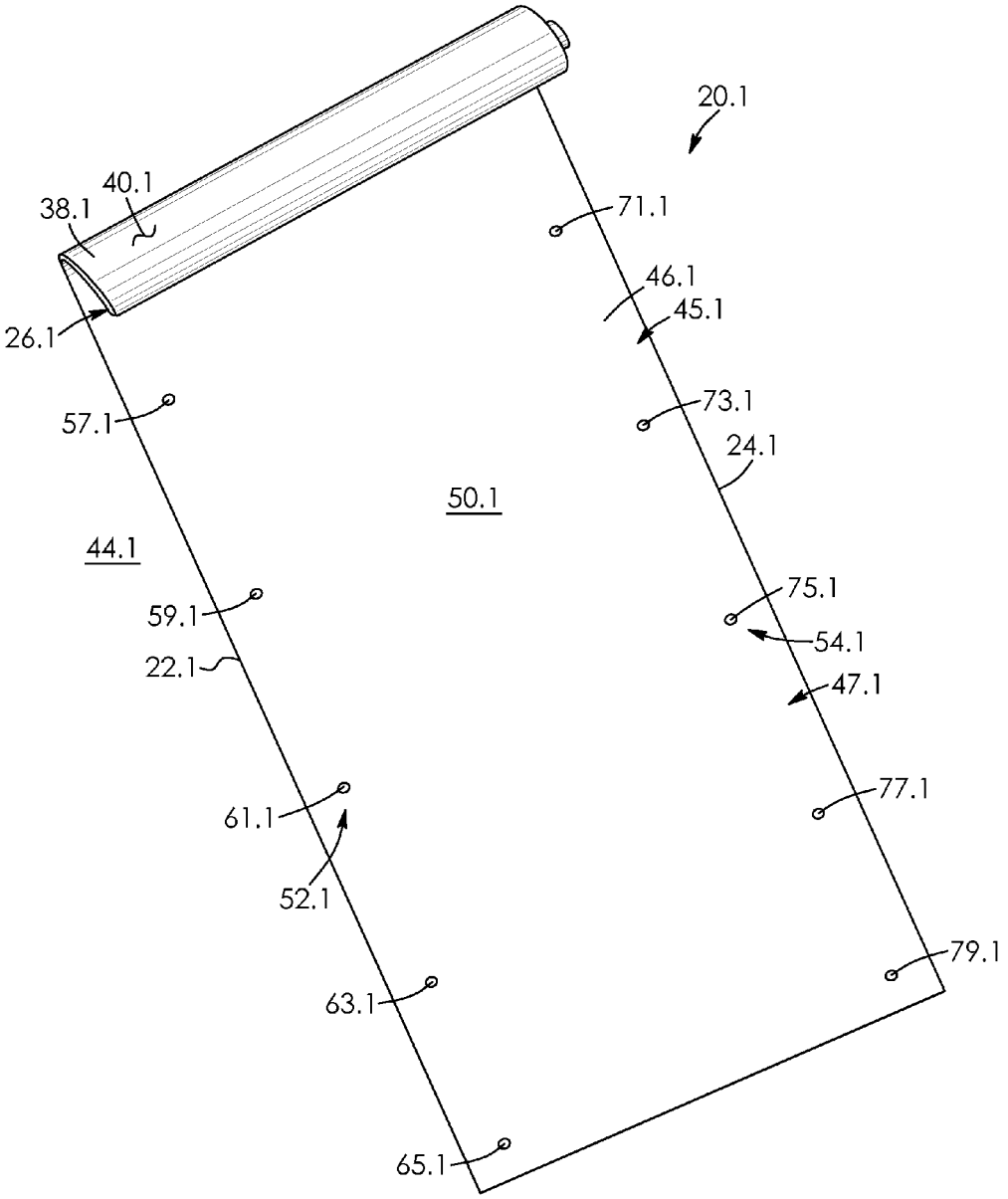
FIG. 7 is a top perspective view of a yoga mat assembly similar to FIG. 1 according to a second aspect.

FIG. 7 shows a yoga mat assembly 20.1 according to a second aspect. Like parts have like numbers and functions as the yoga mat assembly 20 shown in FIGS. 1 to 6 with the addition of decimal extension "0.1". Yoga mat assembly 20.1 is substantially the same as yoga mat assembly 20 shown in FIGS. 1 to 6 with the exception that top 50.1 of sheet 46.1 is free of clusters of protrusions and comprises solely microfiber cloth in this example.

FIGS. 8 to 13 show a yoga mat assembly 20.2 according to a third aspect. Like parts have like numbers and functions as the yoga mat assembly 20 shown in FIGS. 1 to 6 with the addition of decimal extension "0.2". Yoga mat assembly 20.2 is substantially the same as yoga mat assembly 20 shown in FIGS. 1 to 6 with at least the following exceptions.

Figure 9:
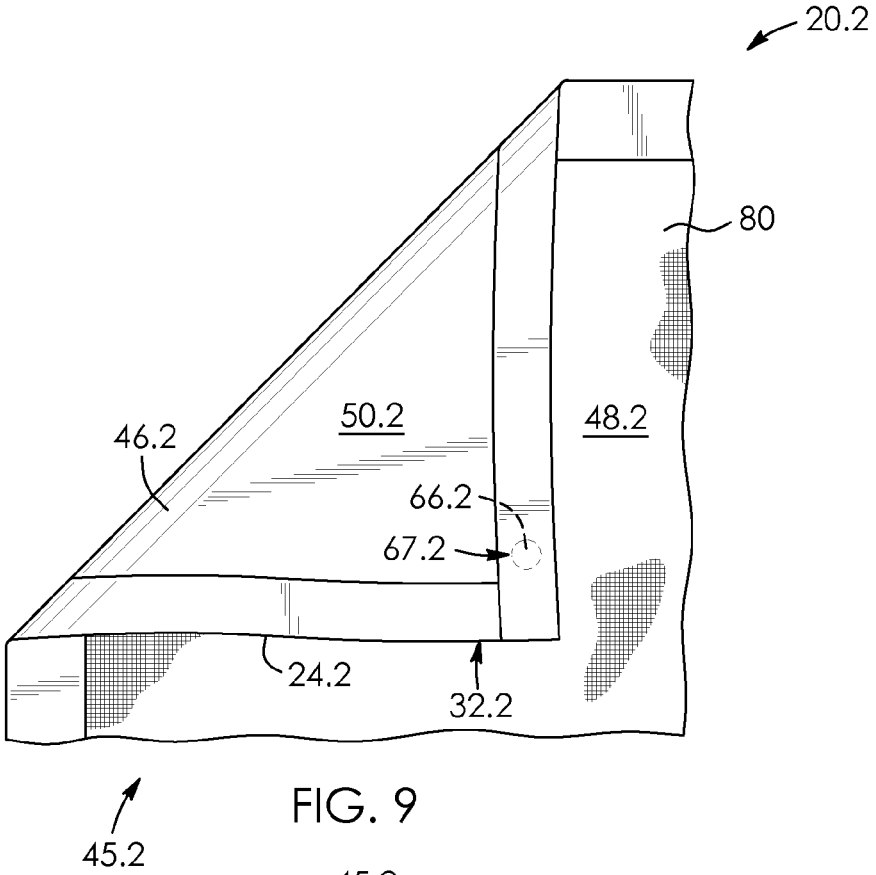
FIG. 9 is an enlarged bottom plan view of one corner portion of the covering member of FIG. 8, the corner portion being folded over to reveal the top of the covering member.
Figure 12:
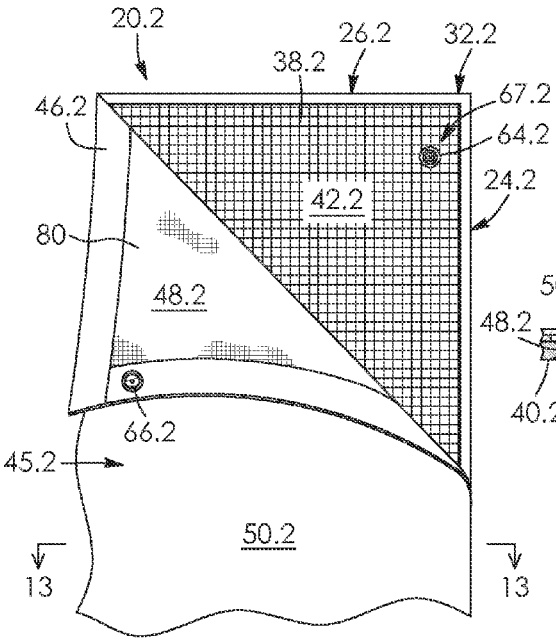
FIG. 12 is a top perspective view similar to FIG. 3 of the yoga mat assembly of FIG. 8 showing the yoga mat and a female portion of a fastener and a corresponding male portion of one of the fasteners connected to the covering member, the covering member being partially folded to reveal a male portion of the fastener.
Figure 13:
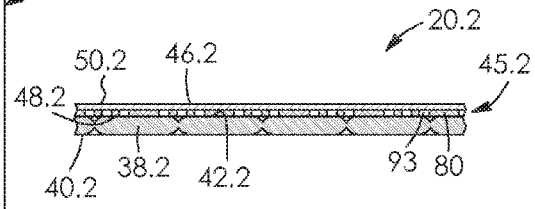
FIG. 13 is a sectional view taken along lines 13-13 of FIG. 12 of the yoga mat assembly of FIG. 8.

As seen in FIGS. 9 and 12, covering member 45.2 comprises a first layer that is moisture-absorbent, in this example a fabric sheet 46.2 comprising microfiber cloth. The fabric sheet extends from the top 50.2 towards the bottom 48.2 of the covering member.

Figure 8:
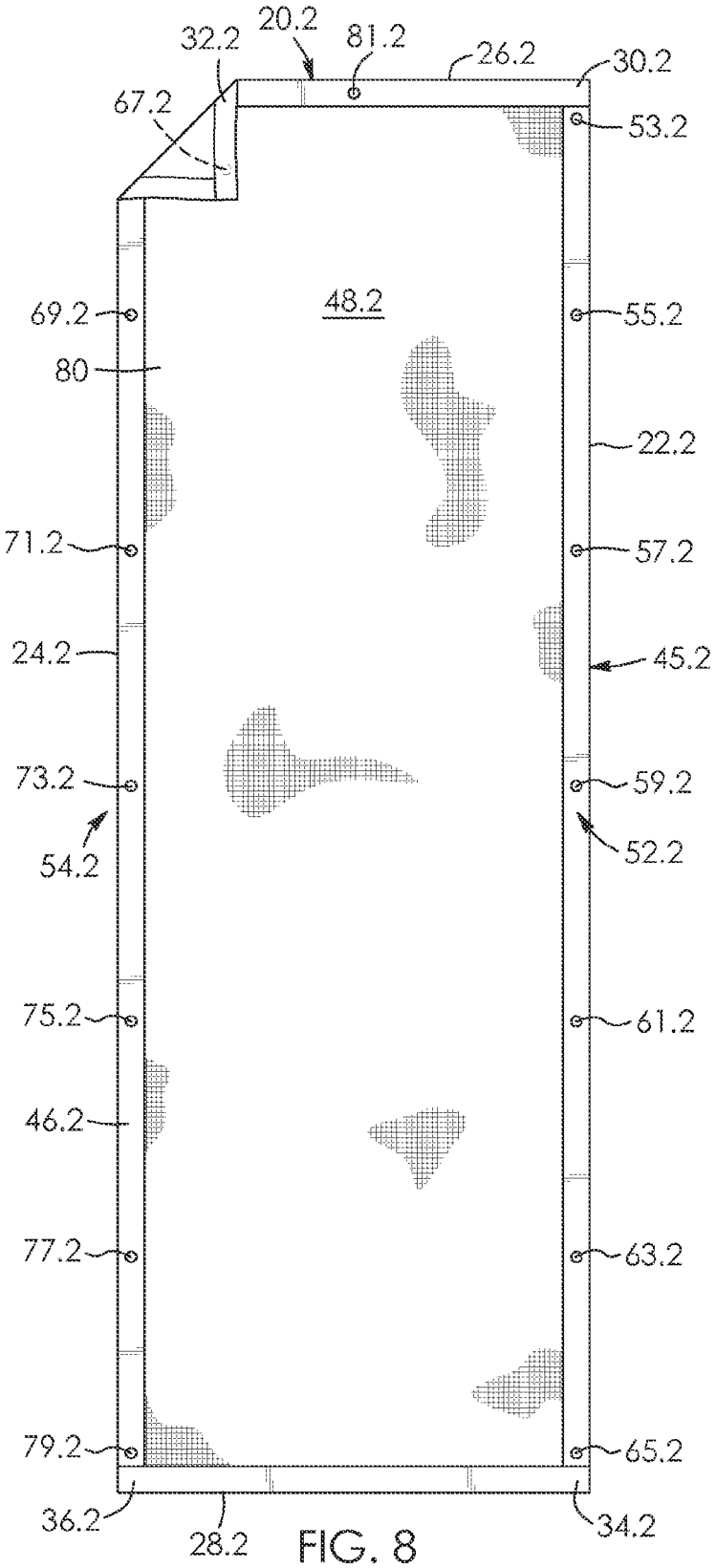
FIG. 8 is a bottom plan view of a covering member of a yoga mat assembly according to a third aspect.
Figure 10:
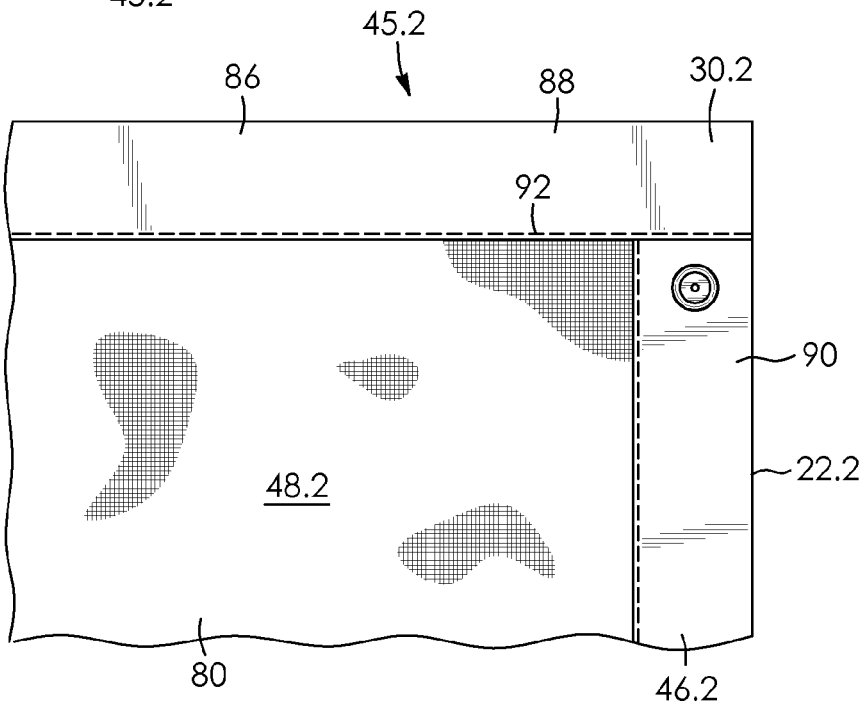
FIG. 10 is an enlarged bottom plan view of another corner portion of the covering member of FIG. 8.
Figure 11:
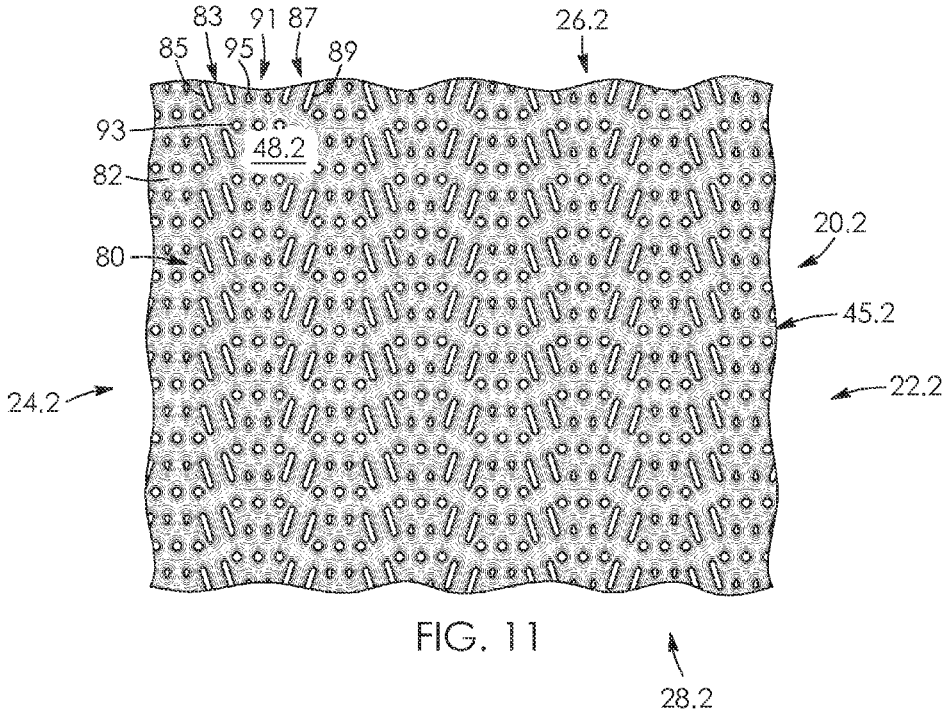
FIG. 11 is an enlarged bottom plan view of a rubberized layer of the covering member.

As best seen in FIGS. 8, 10 and 11, the covering member 45.2 also comprises a second layer 80 configured to inhibit longitudinal and lateral movement of the covering member relative to the yoga mat 38.2. As best seen in FIG. 11, the second layer of the covering member comprises a mesh 82 made of an elastomer, in this example rubber. The covering member 45.2 includes a plurality of longitudinally and laterally spaced-apart apertures extend through the mesh, as shown by aperture 84. As seen in FIG. 10, the fabric sheet 46.2 extends around and covers peripheral portions 86 of the second layer 80 of the covering member 45.2 in this example. Lateral strips 88 and longitudinal strips 90 of the fabric sheet thus cover these peripheral portions on the bottom 48.2 of the covering member 45.2. In this example, the strips and fabric sheet are connected to and held in place relative to the second layer 80 via stitching 92 extending through the strips.

The covering member 45.2 may be referred to as a microfiber cloth with a rubberized backing configured to extend along the yoga mat. The rubberized layer 80 may provide additional wear and non-slip protection to the assembly 20.2.

It will be appreciated that many variations are possible within the scope of the invention described herein. It will also be understood by someone skilled in the art that many of the details provided above are by way of example only and are not intended to limit the scope of the invention which is to be determined with reference to at least the following claims.

What is claimed is:

1. A yoga mat assembly having a length, a width extending perpendicular to the length of the assembly, a first longitudinal side edge and a second longitudinal side edge spaced-apart from the first longitudinal side edge, the longitudinal side edges of the assembly extending along the length of the assembly, and the assembly comprising:

a yoga mat having a longitudinal border and including a first row of fastener members located proximate and spaced from the longitudinal border along opposite longitudinal side edges of the assembly, the first row of fastener members being spaced from respective ones of the longitudinal edges of the assembly by a distance equal to or less than one twelfth of the width of the assembly; and a moisture-absorbent covering member shaped to extend over top of and substantially cover the yoga mat, the covering member including a pair of longitudinal strips, each of the longitudinal strips being adjacent to a respective one of the longitudinal side edges of the assembly, and the longitudinal strips including a second row of fastener members located within a perimeter defined by each of said longitudinal strips, wherein the fastener members of the covering member are configured to mate with the fastener members of the yoga mat.

2. The assembly as claimed in claim 1 wherein one of the rows of fastener members comprises male members and the other of the rows of fastener members comprises female members being shaped to selectively receive and couple with the male members.

3. The assembly as claimed in claim 2, wherein paired ones of said female members and said male members comprise fasteners, the fasteners being snap fasteners.

4. The assembly as claimed in claim 1, the assembly having a forward end extending between the longitudinal side edges of the assembly, and wherein the assembly further includes a fastener interposed between the longitudinal side edges of the assembly adjacent to the forward end thereof, the fastener selectively connecting together the yoga mat and the covering member at the forward end of the assembly.

5. The assembly as claimed in claim 1 wherein the yoga mat is resilient and configured to frictionally engage with a floor.

6. The assembly as claimed in claim 1 wherein the covering member has a coefficient of friction that is greater than that of the yoga mat.

7. The assembly as claimed in claim 1 wherein the covering member includes a first layer and a second layer, the first layer of the covering member being a fabric sheet.

8. The assembly as claimed in claim 7 wherein the second layer of the covering member comprises an elastomeric mesh.

9. The assembly as claimed in claim 7 wherein the first layer of the covering member extends around and covers peripheral portions of the second layer of the covering member.

10. The assembly as claimed in claim 1 wherein the covering member is a microfiber cloth with a rubberized backing configured to extend along the yoga mat.

11. The assembly as claimed in claim 1 wherein the covering member includes a first layer and a second layer, the first layer of the covering member being microfiber cloth.

12. The assembly as claimed in claim 11, wherein the second layer of the covering member comprises an elastomeric mesh.

13. A yoga mat assembly having a length, a width extending perpendicular to the length of the assembly, a first longitudinal side edge, a second longitudinal side edge spaced-apart from the first longitudinal side edge, the longitudinal side edges extending along the length of the assembly, the assembly comprising:

a yoga mat including a first row of fastener members extending along and adjacent to the first longitudinal edge of the assembly and a second row of fastener members extending along and adjacent to the second longitudinal edge of the assembly, the fastener members being spaced from adjacent ones of the longitudinal side edges of the assembly by a distance equal to or less than one twelfth of the width of the assembly; and a moisture-absorbent covering member shaped to extend over top of and substantially cover the yoga mat, the covering member having a bottom, including longitudinal and lateral strips covering peripheral portions of the bottom of the covering member, and including rows of fastener members coupling to the strips, the fastener members of the yoga mat being shaped to selectively couple with the fastener members of the covering member.

14. The assembly as claimed in claim 13 wherein the distance between fastener members in said first row of fastener members is generally equal to or less than one half of the width of the assembly, and wherein the distance between fastener members in said second row of fastener members is generally equal to or less than one half of the width of the assembly.

15. The assembly as claimed in claim 13, wherein each of the fastener members in said first row of fastener members is spaced-apart from the next one of the fastener members in said first row of fastener members by a distance generally equal to or less than one half of the width of the assembly and wherein each of the fastener members in said second row of fastener members is spaced-apart from the next one of the fastener members in said second row of fastener members by a distance generally equal to or less than one half of the width of the assembly.

16. The assembly as claimed in claim 13 wherein the fastener members of the covering member comprise male members and wherein the fastener members of the yoga mat comprise female members shaped to selectively receive and couple with the male members.

17. The assembly as claimed in claim 13 wherein the yoga mat is resilient and configured to frictionally engage with a floor, and wherein the covering member has a coefficient of friction that is greater than that of the yoga mat.

* * * * *